US005248111A

United States Patent [19]

Teckentrup et al.

[11] Patent Number: 5,248,111

[45] Date of Patent: Sep. 28, 1993

[54] YARN WINDING BOBBIN

[75] Inventors: Michael Teckentrup, Radevormwald; Jorg Spahlinger, Wermelskirchen, both of Fed. Rep. of Germany

[73] Assignee: Barmag AG, Remscheid, Fed. Rep. of Germany

[21] Appl. No.: 916,398

[22] Filed: Jul. 20, 1992

[30] Foreign Application Priority Data

Jul. 20, 1991 [DE] Fed. Rep. of Germany ..... 4124128

[51] Int. Cl.[5] ..... B65H 75/28

[52] U.S. Cl. ..... 242/125.1; 242/18 PW

[58] Field of Search ..... 242/125.1, 125.2, 125.3, 242/125, 18 PW, 18 A

[56] References Cited

U.S. PATENT DOCUMENTS

| | | | |
|---|---|---|---|
| 3,103,305 | 9/1963 | Heatherly | 242/125.1 X |
| 4,094,476 | 6/1978 | Schmidt et al. | 242/125.2 |
| 4,867,385 | 9/1989 | Lenk | 242/18 A |
| 4,880,183 | 11/1989 | Kubata et al. | 242/125.1 |

FOREIGN PATENT DOCUMENTS

| | | |
|---|---|---|
| 3923305 | 2/1990 | Fed. Rep. of Germany . |
| 2653418 | 4/1991 | France . |
| WO89/07573 | 2/1989 | PCT Int'l Appl. . |

*Primary Examiner*—Stanley H. Gilreath

*Attorney, Agent, or Firm*—Bell, Seltzer, Park & Gibson

[57] ABSTRACT

A yarn winding bobbin is disclosed which includes a tubular wall composed of wound paper layers, and a yarn catching slot positioned adjacent one end of the tubular wall. The slot includes an inlet portion and a clamping portion, and the inlet portion includes an opening which extends completely through the wall. A yarn trap is formed in the opening for engaging a yarn which is positioned to move in the direction of rotation of the bobbin. The yarn trap is configured in such a manner that in the event of a suddenly occurring force exerted on the yarn, the yarn trap will not be destroyed. This is accomplished in that the yarn trap includes a yarn engaging edge which extends through the entire thickness of the wall of the bobbin, so that the yarn engages the entire thickness and not the individual paper layers.

9 Claims, 4 Drawing Sheets

YARN WINDING BOBBIN

BACKGROUND OF THE INVENTION

The present invention relates to a yarn winding bobbin having a yarn catching slot of novel construction.

German patent application DE 39 23 305 Al discloses a yarn winding bobbin for the takeup of a yarn, in particular a synthetic filament yarn, and wherein the yarn is caught by a process involving codirectional movement of the yarn and a yarn catching slot. The yarn catching slot of this prior winding tube consists of an inlet portion and a clamping portion. The inlet portion is sufficiently wide so that the yarn drops easily down to the bottom thereof, but the clamping portion is relatively narrow and serves to grip the yarn and exert considerable tensile forces on the yarn.

In the known winding tube, a yarn trap is provided in the region of the inlet portion of the slot, which does not hinder the radial entry of the yarn into the inlet portion, but blocks, preferably in a form-locking manner, its radial- exit from the clamping portion.

It is the object of the present invention to provide a yarn winding bobbin having an improved yarn catching slot of the type having a yarn trap. The invention is particularly suitable for the processing of coarse yarns, or yarns having a high tensile strength, and wherein very high and very suddenly occurring yarn forces act upon the yarn trap. When the winding tube is formed of cardboard or wound layers of paper, there is a risk that in such cases the yarn trap, which also consists of layers of paper, is shredded. It is a further object of the present invention to avoid such shredding of the yarn trap.

SUMMARY OF THE INVENTION

The above and other objects and advantages of the present invention are achieved in the embodiment disclosed herein by the provision of a yarn winding bobbin which comprises a cylindrical tubular wall defining a longitudinal axis and opposite ends. A yarn catching slot is formed in the wall adjacent one of the ends and extends in a circumferential direction, with the slot comprising an inlet portion and a clamping portion. The inlet portion is in front of the clamping portion when viewed in the intended direction of rotation of the bobbin, and the inlet portion is sufficiently wide to permit a yarn to be freely received therein in the radial direction. The clamping portion is sized to frictionally engage a yarn which is radially received therein.

The inlet portion of the slot includes an opening which extends radially through the wall, with the opening having oppositely facing side edges, and a yarn trap is formed in one of the side edges of the opening, with the yarn trap including a yarn engaging edge which faces away from the clamping portion of said slot and which extends along a direction having a substantial axial component.

In use, the bobbin is rotated about its longitudinal axis, and when a yarn is positioned circumferentially along the slot it will drop into the slot and radially through the opening, and the yarn may then be guided along the one side edge of the opening so as to be engaged by the yarn engaging edge of the yarn trap while a trailing portion of the yarn is engaged by the clamping portion of the slot. Since the yarn engaging edge of the yarn trap extends radially through the entire thickness of the tubular wall of the bobbin, the yarn engages the entire thickness of the wall and not its individual paper layers. More particularly, the yarn engaging edge is positioned such that the yarn which drops into the opening of the inlet portion of the slot extends radially below the yarn engaging edge. When the yarn is then guided along the side edge of the opening which includes the yarn trap, it first drops into the trap and is then engaged by the entire thickness of the yarn engaging edge and is carried along thereby. In so doing, an increasing looping of the yarn develops on the yarn engaging edge, with the consequence that the yarn binds together to an increasing extent the exposed layers of paper of the winding bobbin and thereby further strengthens the winding bobbin in this region.

The yarn engaging edge of the yarn trap preferably extends substantially in an axial direction. It may, however, form an obtuse angle with the catching slot, as long as this angle is in the self-locking range, i.e., as long as there is no risk that the yarn slides down axially along the yarn engaging edge. Likewise, the yarn engaging edge may form an acute angle with the yarn slot. However, the thereby formed, arrow-shaped projection should not be unduly weakened. Taking further into account the aspect of a simple manufacture, the perpendicular extension of the yarn engaging edge appears to be particularly advantageous.

BRIEF DESCRIPTION OF THE DRAWINGS

Some of the objects and advantages of the present invention having been stated others will appear when the description proceeds when taken in conjunction with the accompanying drawings in which.

DETAILED DESCRIPTION OF THE PREFERRED EMBODIMENTS

Figure 1A:
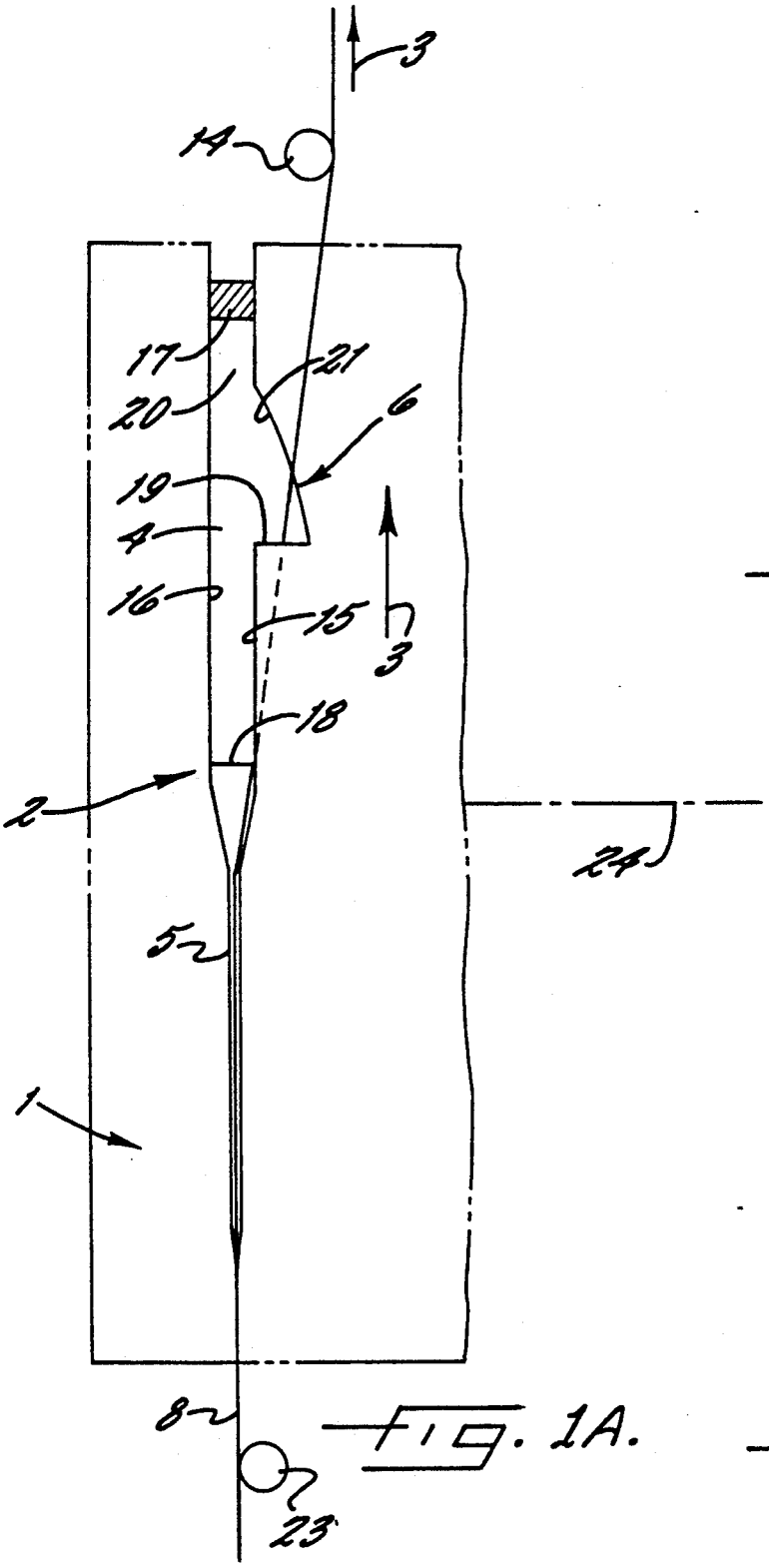
FIG. 1A is a fragmentary side elevation view of a yarn winding bobbin which includes the yarn catching slot which embodies the features of the present invention.

Referring more particularly to the drawings, FIG. 1A illustrates the left end of a yarn winding bobbin 1 and a portion of a preferred embodiment of the yarn catching slot 2 of the present invention. The bobbin 1 comprises a tubular cylindrical wall which defines a longitudinal axis 24 and opposite ends, with the left end being illustrated in FIG. 1A. The yarn catching slot 2 is positioned adjacent the left end of the bobbin, and the yarn catching slot extends in a circumferential direction which is generally perpendicular to-the longitudinal axis 24 and over an angle of, for example, at least 120°. Assuming that both the surface of the bobbin 1 and the yarn 8 move in the direction of arrow 3, the yarn catching slot starts with an inlet portion 4. This inlet portion 4 distinguishes itself by a relatively great width in comparison with the diameter of the yarn. The inlet portion 4 may extend, for example, over about 90° to 180° of the circumference of the bobbin. A clamping portion 5 follows the inlet portion 4, which has a small width relative to the yarn diameter. Specifically, the clamping portion 5 is sufficiently narrow so as to grip the yarn and thus exert a considerable tensile force on the yarn, and it extends, for example, over about 90° of the circumference of the bobbin.

The inlet portion 4 includes an opening 20 which extends radially completely through the wall of the bobbin, with the opening 20 having oppositely facing side edges 15, 16, and opposite end edges 17, 18. Preferably, the opening 20 extends circumferentially over an angle of between about 75 and 100 degrees.

A yarn trap 6 is formed in the side edge 15 of the opening 20, at about the circumferential midpoint of the opening. The yarn trap 6 includes a yarn engaging edge 19 which faces away from the clamping portion 5 of the slot, and which extends in a direction substantially parallel to the longitudinal axis 24 of the bobbin and thus substantially perpendicular to the side edge 15. The yarn trap 6 is further defined by an inclined edge 21 extending from the side edge 15 to the inner end of the yarn engaging edge 19 which is spaced from the side edge 15.

In operation, the yarn 8 is withdrawn by means of a suction gun (not shown) or a driven, full package, note PCT/DE 89/00094. A feed system (not shown) delivers the yarn, or the synthetic filament yarn may be freshly spun and advancing directly from the spinneret. A winding spindle 10 (FIG. 2A) with an empty bobbin 1 mounted thereon is driven substantially at a surface speed which corresponds to the yarn speed. The winding spindle 10 is moved into the yarn path such that the direction of the surface movement of the winding bobbin corresponds to the direction 3 of the advancing yarn. A yarn guide 23 positioned upstream of the bobbin 1 in the direction of the advancing yarn guides the yarn into the normal plane of the yarn catching slot 2. The yarn is withdrawn over yarn guide 14 which is located somewhat laterally from the normal plane of the yarn catching slot, in a direction toward the axial center of the winding bobbin.

Figure 2A:
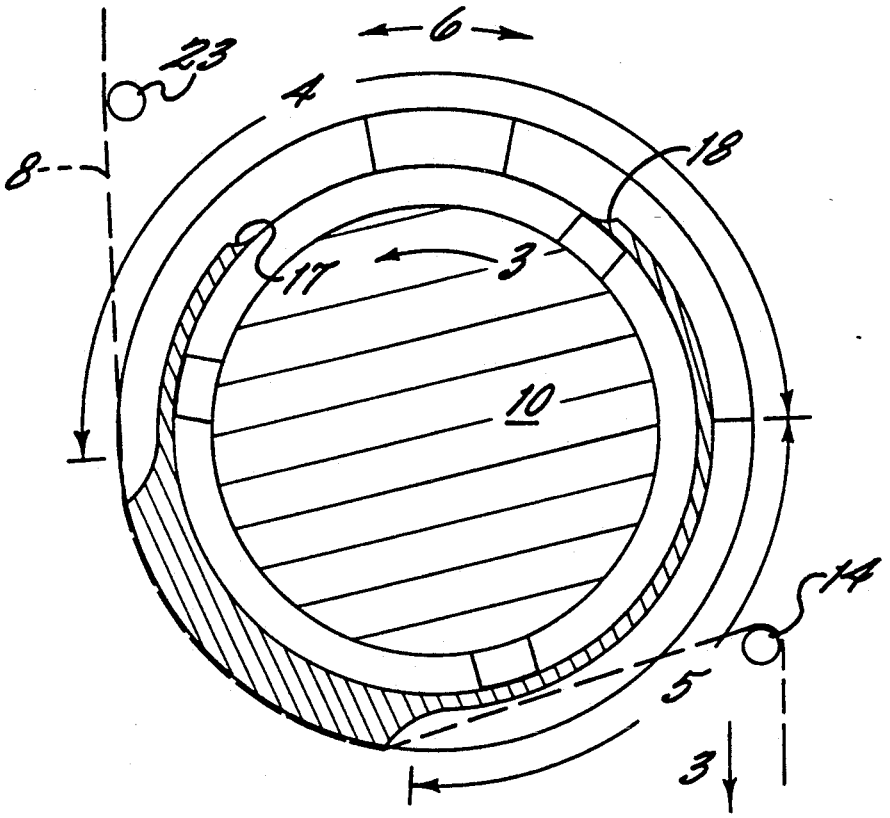
FIGS. 2A–2F are transverse cross sectional views illustrating the bobbin of the present invention mounted on a spindle and illustrating the sequential steps of the yarn catching operation in accordance with the present invention.
Figure 2B:
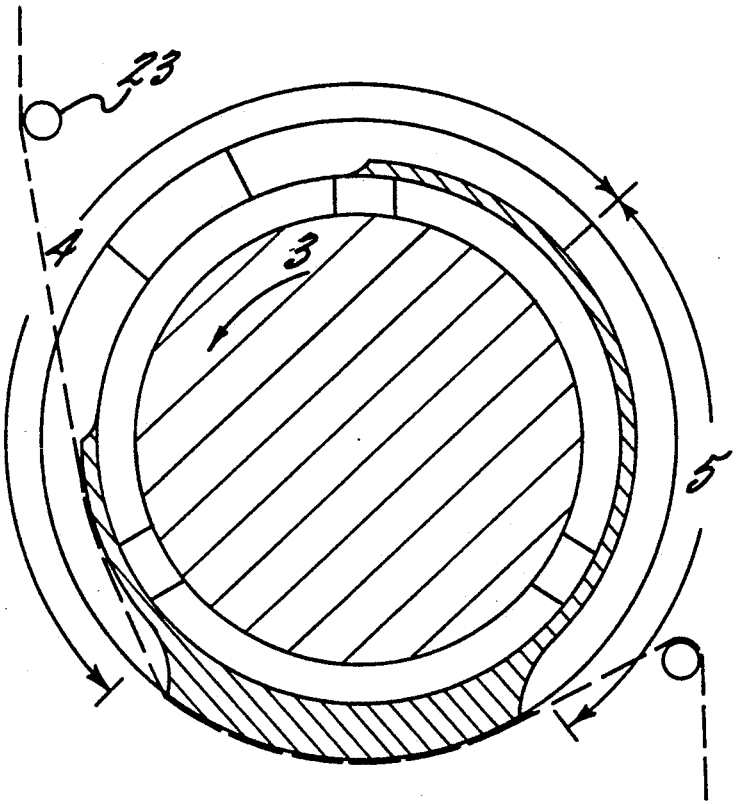
Figure 2C:
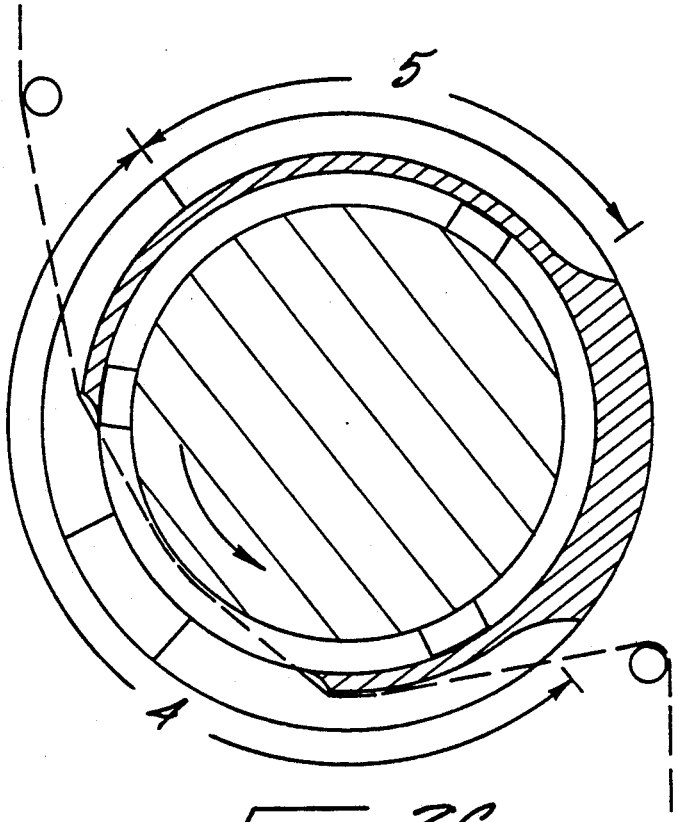
Figure 2D:
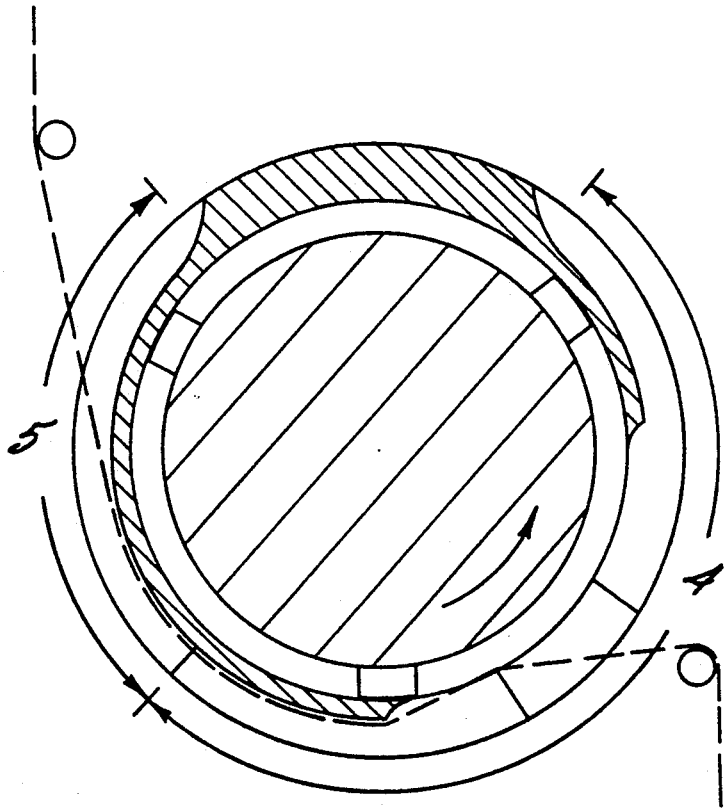

The end edges 17 and 18 of opening 20 are spaced from the yarn engaging edge 19 such that the yarn which drops into the inlet portion 4 falls through the opening 20 and forms a secant on the inner circumference of the winding bobbin, as is shown in FIG. 2C. The axial extent of the yarn trap 6 is not critical and it may amount to a few millimeters, enough in any event, so that an adequate length is present for engaging the yarn.

Figure 1B:
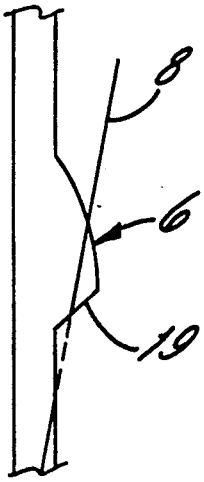
FIGS. 1B and 1C are fragmentary side elevation views of the inlet portion of the yarn catching slot and illustrating two embodiments of the yarn engaging edge.

As is shown in FIG. 1B, the yarn engaging edge 19 may also form an obtuse angle with the side edge 15 of the opening of the yarn catching slot. In this instance, the angle should not be so large that the yarn guided around the yarn engaging edge 19 slides by itself in a direction toward the inlet portion. In this regard, it is desirable to have an automatic locking of the yarn.

Figure 1C:
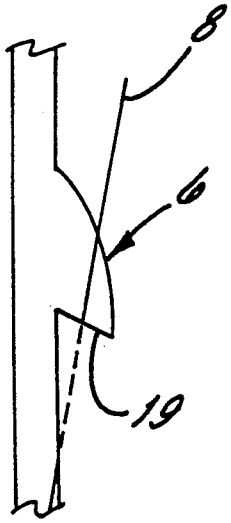

As is shown in FIG. 1C, the yarn engaging edge 19 may also form an acute angle with the side edge 15 of the opening. In this instance, it would be harmless, if the yarn slid down along the yarn engaging edge in the direction toward the nip formed by the trap 6. However, it is necessary that the arrow-shaped projection which is thus formed by the yarn engaging edge, remain adequately strong so as to apply the forces necessary to rupture the yarn. The above described obtuse and acute angles are preferably selected such that the yarn engaging edge 19 extends along a direction which defines an angle of between about 60 and 120 degrees with the side edge 15.

In operation, to catch the yarn on the bobbin, the yarn guides 14, 23 on the one hand and the bobbin on the other hand are positioned in such a manner that the yarn loops about the bobbin in the normal plane of the catching slot, preferably at more than 90°, but preferably not more than 180°.

FIG. 2A shows the rotated position of the winding bobbin, in which the front end of the inlet portion 4 of the catching slot has reached the point at which the yarn 8 contacts the winding tube.

FIG. 2B shows that the yarn drops into the inlet portion 4 as the winding bobbin continues to rotate. To this end, the axial width of the inlet portion is selected so that the yarn reaches the bottom of the inlet portion 4 without any substantial obstruction. It should be noted in particular that the inlet portion 4 has substantially the same depth as, or a greater depth than the clamping portion 5 of the catching slot as will be described below. However, in its central region, the inlet portion extends through to the inner circumference of the winding tube 1 to form the opening 20. The end edges 17 and 18 of the opening extend along a secant of the inner circumference of the wall of the bobbin.

The yarn thus drops down to the bottom of the inlet portion 4, or respectively forms a secant to the inner circumference of the winding bobbin between the end edges 17 and 18 of the opening. As a result, the speed of the advancing yarn is slightly greater, on the order of about 1%, than the translatory speed of the yarn slot or the bobbin. The thereby developing relative speeds however do not become effective in the form of frictional forces acting on the yarn, since the inlet portion 4 is so wide that it does not substantially interfere with the yarn. Nonetheless, the developing yarn tensions and relative speeds suffice to pull the yarn as deep as possible into the catching slot or respectively the inlet portion and clamping portion.

FIG. 2C illustrates the function of the yarn trap 6. In this connection, it should be mentioned that while the yarn moving in direction 3 advances exactly in the normal plane of the catching slot 2, the yarn length moving toward the yarn guide 14 has a component of movement in a direction toward the longitudinal center of the winding tube. This deviation amounts to few degrees. As a result, in FIG. 2C, the yarn having again exited from the inlet portion 4 contacts the side edge 15 of the opening 20 of the inlet portion.

When, as a result of the further rotation of the winding bobbin, the yarn now passes the yarn trap 6, it slides also into the trap due to its laterally directed component. Further, since the trap is arranged in the opening 20 of the inlet portion 4, the yarn which forms in the region the secant to the inner circumference, moves below the yarn engaging edge 19 which borders the trap 6. The yarn engaging edge 19 prevents the exit of the yarn from the inlet portion with a form-locking obstruction. When, as a result of the continued rotation of the winding bobbin, the yarn engaging edge 19 has passed the tangent between the yarn guide 14 and the winding bobbin, the yarn is increasingly deflected on the yarn engaging edge 19. As a result of this deflection, the yarn engaging edge is compressed, so that the layers of paper, of which the wall of the tube is formed, are compressed and stiffened. Further, the yarn is detained on the slot bottom, and can, therefore, not be pulled out radially from the following clamping portion 5. Consequently, the clamping forces which are exerted on the yarn in the clamping portion 5, become effective only in the circumferential direction and direction of yarn advance, but not in a radial direction transverse to the yarn. Therefore, the clamping forces are converted exclusively into tensile forces of the yarn.

The clamping portion 5 is configured such that clamping forces are exerted on the yarn very suddenly. This is accomplished in that the clamping portion narrows very suddenly relative to the inlet portion to such an extent that a strong frictional engagement or practically a form-locking engagement occurs between the yarn and the side walls of the catching slot. It should here be noted that it is synthetic multifilament yarns which offer multiple possibilities of contact for a form-locking engagement with the winding bobbins made of cardboard or wound layers of paper.

Figure 2F:
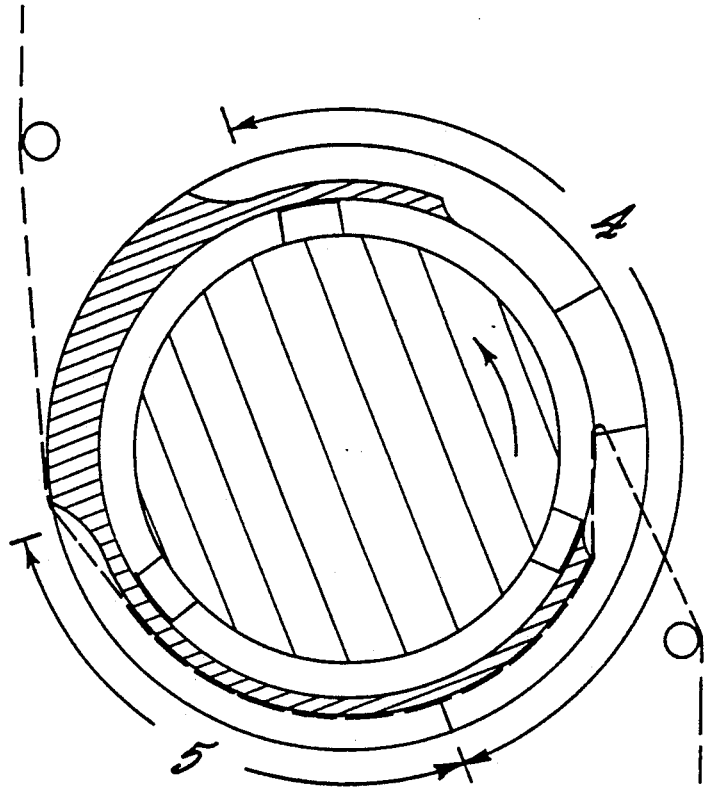
Figure 2E:
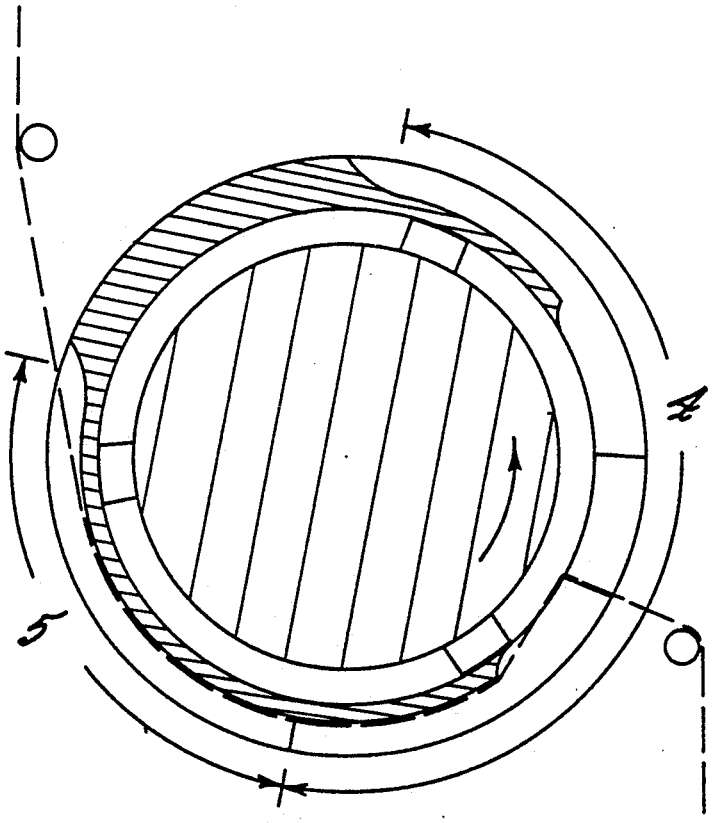

Shown in FIG. 2E is a rotated position, in which the yarn 8 is deflected for the first time on the yarn engaging edge 19 of the yarn trap 6.

Shown in FIG. 2F is a rotated position, in which the yarn is deflected to its maximum extent on the yarn engaging edge 19 of the yarn trap 6. It is understood that in this position the yarn will rupture, when it is a not too strong. However, the clamping forces of clamping portion 5 continue to remain effective, and the yarn continues to be advanced in direction 3. Consequently, the tensile forces of the yarn continue to increase considerably. The yarn break may be aided by a correspondingly sharp edge on the yarn guide 14. Thereafter, the yarn is wound on the bobbin 1. As described in the above cited prior patent application, the traversing motion can now restart, and the yarn can be traversed on the winding bobbin 1 to form a cross-wound package.

In the drawings and specification, there has been set forth a preferred embodiment of the invention, and although specific terms are employed, they are used in a generic and descriptive sense only and not for purposes of limitation.

That which is claimed is:

1. A yarn wind bobbin adapted for having a yarn wound thereupon to form a cross wound package or the like, and comprising a cylindrical tubular wall defining a longitudinal axis and opposite ends, a yarn catching slot formed in said wall adjacent one of said ends and extending in a circumferential direction, said slot comprising an inlet portion and a clamping portion, with the inlet portion being in front of the clamping portion when viewed in the intended direction of rotation of the bobbin, with said inlet portion being sufficiently wide to permit a yarn to be freely received therein in the radial direction and with said clamping portion being sized to frictionally engage a yarn which is radially received therein, said inlet portion including an opening which extends radially through the entire thickness of said wall, with said opening having oppositely facing side edges, a yarn trap formed in one of said side edges of said opening, said yarn trap including a yarn engaging edge which faces away from said clamping portion of said slot and which extends along a direction having a substantial axial component so as to define an inner end spaced from said one side edge, and an inclined edge extending from said one side edge to said inner end of said yarn engaging edge, whereby, upon rotation of said bobbin about said longitudinal axis, a yarn positioned circumferentially along said slot will drop into said slot and radially through said opening, and the yarn may then be guided along said one side edge of said opening so as to be engaged by said yarn engaging edge of said yarn trap which a trailing portion of the yarn is engaged by said clamping portion of said slot.

2. The yarn winding bobbin as defined in claim 1 wherein said yarn engaging edge extends along a direction so as to define an angle of between about 60 and 120 degrees with said one side edge.

3. The yarn winding bobbin as defined in claim 1 wherein said yarn engaging edge extends along a direction which is substantially parallel to said longitudinal axis and perpendicular to said one side edge.

4. The yarn winding bobbin as defined in claim 1 wherein said yarn catching slot extends in a direction which is substantially perpendicular to said longitudinal axis and circumferentially over an angle of at least 120 degrees.

5. The yarn winding bobbin as defined in claim 4 wherein said inlet portion of said slot extends circumferentially over an angle of about 90 and 180 degrees.

6. The yarn winding bobbin as defined in claim 5 wherein said opening of said inlet portion of said slot extends circumferentially over an angle of between about 75 and 100 degrees.

7. The yarn winding bobbin as defined in claim 6 wherein said yarn engaging edge of said yarn trap is positioned at about the circumferential midpoint of said opening.

8. The yarn winding bobbin as defined in claim 1 wherein said tubular wall comprises wound paper layers.

9. The yarn winding bobbin as defined in claim 1 wherein said yarn engaging edge of said yarn trap is positioned at about the circumferential midpoint of said opening.

* * * * *